US009498928B2

(12) United States Patent
McCracken et al.

(10) Patent No.: US 9,498,928 B2
(45) Date of Patent: Nov. 22, 2016

(54) FORMING CONVEYOR FOR A CARTON

(75) Inventors: Kenny E. McCracken, Dacula, GA (US); David C. Wallace, Lilburn, GA (US); Clifton R. Howell, Buford, GA (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 729 days.

(21) Appl. No.: 13/410,587

(22) Filed: Mar. 2, 2012

(65) Prior Publication Data

US 2012/0240528 A1 Sep. 27, 2012

Related U.S. Application Data

(60) Provisional application No. 61/466,304, filed on Mar. 22, 2011.

(51) Int. Cl.
*B31B 1/00* (2006.01)
*B65B 21/18* (2006.01)

(52) U.S. Cl.
CPC ..... *B31B 1/00* (2013.01); *B31B 2201/282* (2013.01)

(58) Field of Classification Search
CPC ..... B31B 1/88; B65B 21/18
USPC ..... 493/55, 319, 309, 311, 317, 318; 198/626.5–626.6
See application file for complete search history.

(56) References Cited

U.S. PATENT DOCUMENTS 3,888,164 A * 6/1975 Taddei ..... 493/316
4,354,333 A * 10/1982 McArdle ..... B65B 27/04 53/291
4,519,181 A * 5/1985 Sherman ..... B65B 49/12 493/151
4,571,236 A * 2/1986 Adams ..... B31B 1/06 198/470.1
5,127,894 A * 7/1992 Maccaferri ..... B65B 43/285 493/316
5,509,257 A * 4/1996 Tagliaferri ..... B65B 35/205 53/252
5,531,661 A * 7/1996 Moncrief ..... 493/313
6,050,063 A * 4/2000 Ford et al. ..... 53/458
6,427,827 B1 * 8/2002 Berndtsson ..... 198/626.6
6,872,176 B2 * 3/2005 Wyss ..... B65B 43/285 493/123

* cited by examiner

*Primary Examiner* — Andrew M. Tecco
*Assistant Examiner* — Chelsea Stinson
(74) *Attorney, Agent, or Firm* — McCarter & English, LLP

(57) ABSTRACT

The disclosure relates to a conveyor for unfolding a flat, folded rigid or semi-rigid container blank into a container. The conveyor includes two opposing lugged chain conveyor assemblies which are separated at a sufficient distance at the entry end to receive and engage a folded blank between opposed notches in the two lugged chain conveyor assemblies. As the folded blank progresses in the machine direction, the two opposing lugged chain conveyor assemblies become closer to each other so as to unfold the blank into a container with a storage volume therewithin.

16 Claims, 4 Drawing Sheets

FORMING CONVEYOR FOR A CARTON

This application claims priority under 35 U.S.C. §119(e) of U.S. provisional application Ser. No. 61/466,304 filed Mar. 22, 2011, the disclosure of which is hereby incorporated by reference.

BACKGROUND OF THE DISCLOSURE

Field of the Disclosure

The present disclosure pertains to a conveyor for unfolding a flat, folded rigid or semi-rigid container blank into a container with a storage volume therewithin.

Description of the Prior Art

The prior art includes containers with a semi-rigid or rigid carton portion and a polymer header, typically including a reclosable element. Such containers are disclosed in PCT applications PCT/US 10/48615; PCT/US 10/48616; PCT/US 10/48617 and PCT/US10/48619, all filed on Sep. 14, 2010 and entitled "Carton With Plastic Reclosable Header", the contents of all of which are hereby incorporated by reference. While these containers, as well as the apparatus and methods for manufacturing them, have been well-adapted for their intended purposes, improvements are sought in the manufacture of these cartons, particularly with respect to increasing manufacturing speed and reliability, along with reducing manufacturing costs. In particular, previously, the unfolding of the folded carton blanks to form a rectangular carton with a storage volume therein was typically performed by placing the folded blanks into a conveyor pocket. At higher manufacturing speeds, this could result in the polymeric header being sucked into the carton as well as lack of control of the direction in which the header folded.

OBJECTS AND SUMMARY OF THE DISCLOSURE

It is therefore an object of the present disclosure to provide increased manufacturing speeds and reliability, as well as reduced manufacturing costs, with respect to cartons with a rigid or semi-rigid carton portion and a polymer header, typically with a reclosable element.

It is therefore a further object of the present disclosure to provide for the accurate unfolding of the folded carton blanks while controlling the position of the polymeric header.

These and other objects are obtained by providing a conveyor that gradually forms the carton thereby controlling the film and folding the carton. The flat folded carton is placed into a lugged conveyor that has a notch for engaging a folded edge of the carton. As the distance between the two sets of lugs decreases, an irregular polygon shape is formed by the unfolding carton. As the two sets of lugs progressively approach each other, the rectangular carton is formed. The lugged conveyor also pulls the formed carton through guides to fold the film header. Finally, the formed carton is discharged and ready for the next manufacturing step.

BRIEF DESCRIPTION OF THE DRAWINGS

Further objects and advantages of the disclosure will become apparent from the following description and from the accompanying drawings, wherein.

DETAILED DESCRIPTION OF THE PREFERRED EMBODIMENTS

Figure 3:
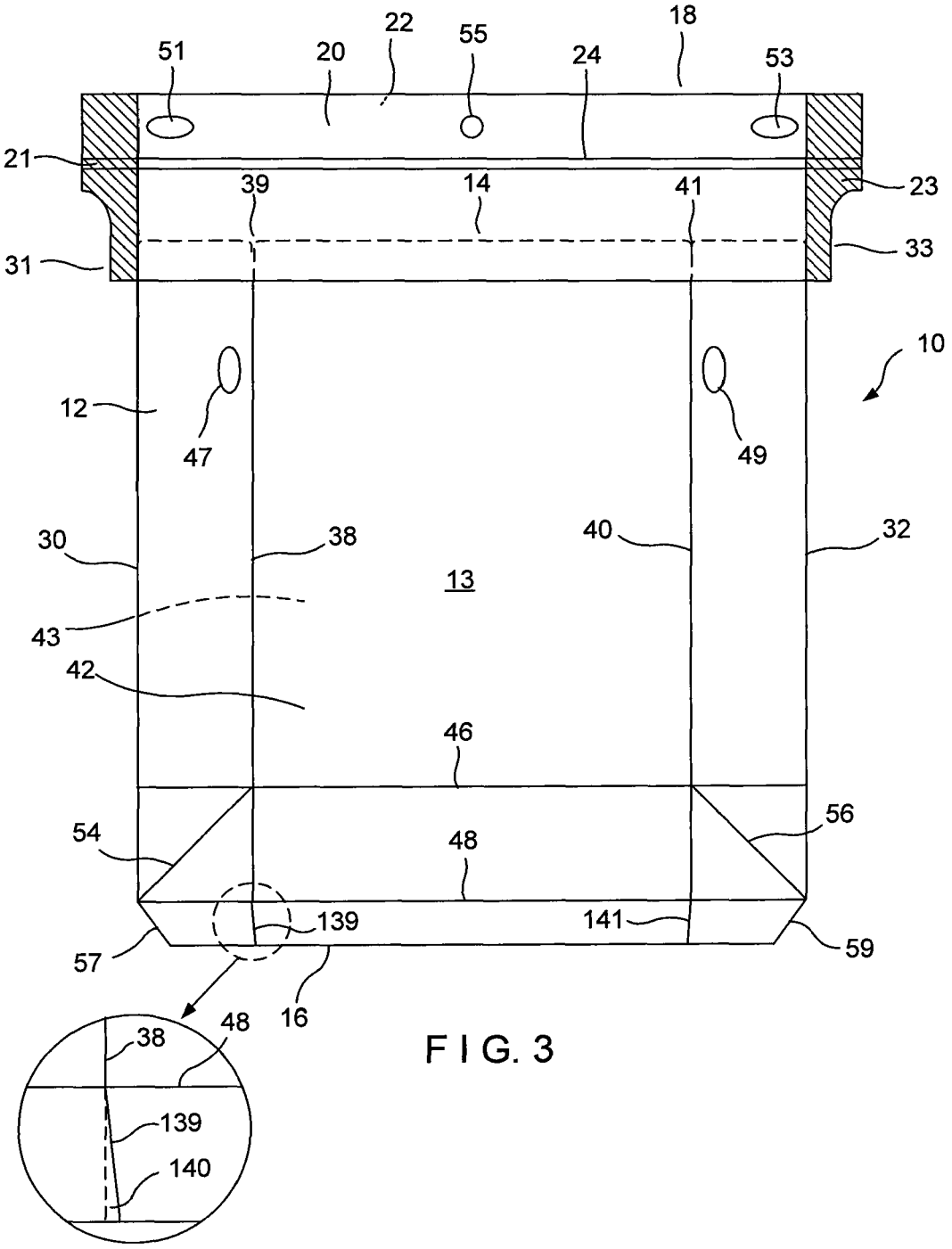
FIG. 3 is a plan view of a typical folded blank for the carton of the present disclosure.
Figure 4:
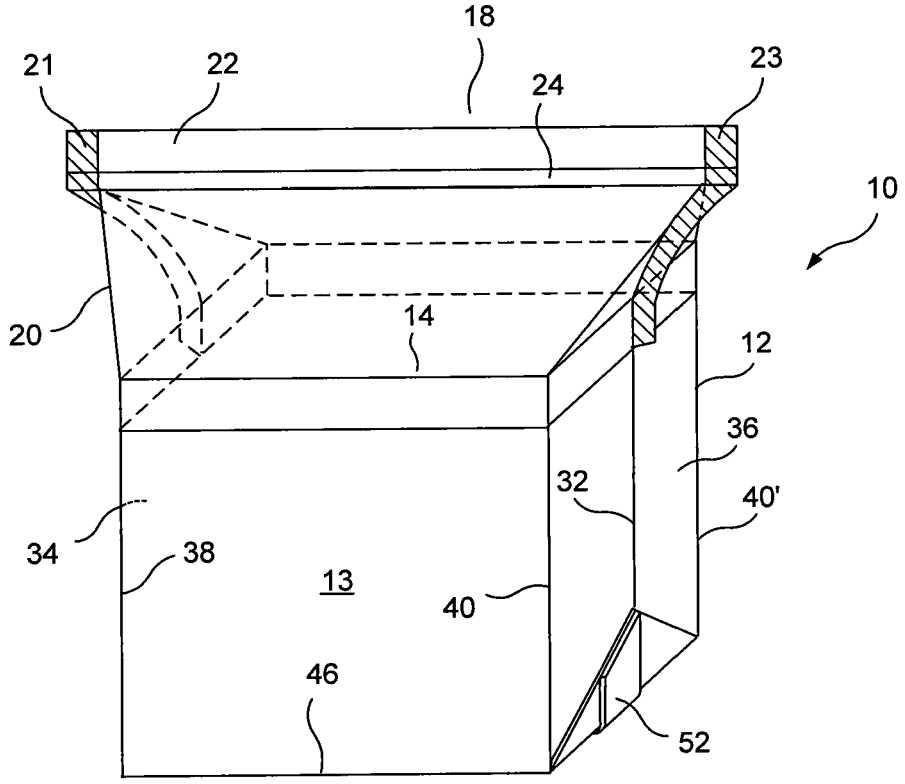
FIG. 4 is a perspective view of a typical carton of the present disclosure.

Referring now to the drawings in detail wherein like numerals indicate like elements, one sees that FIG. 4 is a perspective view of an embodiment of the package 10 which is the typical product of the present disclosure. Package 10 will be described prior to the description of the apparatus of the conveyor of the present disclosure. Package 10 includes a rigid, semi-rigid or fibrous carton-type container 12, typically with a central layer made from a paper product such as fiberboard or chipboard and an interior surface with an oxygen barrier and a moisture barrier and a poly-coated outer layer, but is not limited thereto (hereinafter, collectively referred to as a "semi-rigid container"). Semi-rigid container 12 is typically initially provided in a flat folded configuration as shown in FIG. 3 with an open top or mouth 14 and an open bottom 16. Package 10 further includes a plastic or polymeric header 18 (typically applied by heat, adhesive or glue) which includes first and second sidewalls 20, 22 and a reclosure (or closure) 24, typically implemented as a zipper with first and second interlocking profiles, but is not limited thereto.

The header 18 is sealed or glued to the mouth 14 of semi-rigid container 12. First and second cross-seals 21, 23 or other methods of attachment are formed at the ends of header 18 between the sidewalls 20, 22, immediately outwardly adjacent from first and second folded edges (or first and second exterior folds) 30, 32. The first and second cross-seals 21, 23 further typically include respective first and second side incisions or notches 31, 33 in order to remove material to aid in the subsequent folding of the header 18. Other shapes, such as single or multiple radius cut-outs are also envisioned. It is noted that it is envisioned that some applications may fold the header 18 onto the top of the package 10. However, it will be preferred in many applications that the reclosure or zipper 24 not be bent 180 degrees. The header 18 may be made with bio-degradable plastic. Additionally, in such an embodiment, the sealant for semi-rigid container 12 would also be made bio-degradable.

As shown in FIG. 3, semi-rigid container 12 is typically initially provided in a flat state with front panel 13 and rear panel 15. Semi-rigid container 12 is typically partially or fully poly-coated on the exterior surface, particularly in the areas where heat sealing is required, such as the top of semi-rigid container 12 where header 18 is attached, and the portions of semi-rigid container 12 where the bottom is sealed shut before or after filling. Alternately, adhesive is applied in the required areas and the attachment is done by these adhesives. Additionally, interior coating or lamination may include other materials required for the necessary barrier properties, including hermeticity and oxygen-moisture barriers. Front panel 13 and rear panel 15 are joined to each other by first and second folded edges 30, 32 which ultimately become the central folds of the first and second gusseted sides 34, 36 of semi-rigid container 12 in the expanded or filled configuration as shown in FIG. 4. Front panel 13 of semi-rigid container 12 further includes first and second front interior vertical folds 38, 40 which are inwardly adjacent from and parallel to first and second folded edges 30, 32. In the expanded or filled configurations as shown in FIG. 4, first and second front interior vertical folds 38, 40 form the transition from the front surface 42 to the gusseted sides 34, 36. Similar first and second rear interior vertical folds (see 40' on FIG. 4) are formed on the rear of the semi-rigid container 12, forming the transition from the rear surface 43 to the gusseted sides 34, 36. As shown in FIG. 3, the upper ends of vertical folds 38, 40 may terminate in chamfered sections 39, 41, respectively, in order to prevent cracking of the material of semi-rigid container 12 during folding and further to reduce the likelihood of the material of semi-rigid container 12 forming a point to puncture the material of header 18.

As further shown in FIG. 3, first and second interior horizontal folds 46, 48 are formed on front panel 13 adjacent to the bottom 16. A similar first interior horizontal fold is formed on the rear panel 15 of semi-rigid container 12. The first interior horizontal folds 46 are used to form the transition to the bottom surface 50 while the second interior horizontal fold 48 is used to form the fin seal 52 as shown in FIG. 4. A second horizontal fold is not illustrated on the rear panel 15, as typically, only one of panels 13, 15 include a second horizontal fold in order to help force the fin seal 52 to fold in a specific direction. As shown in the area of detail of FIG. 3, the lower portions of first and second front interior vertical folds 38, 40 form respective first and second inwardly inclined fold portions 139, 141. As shown in the area of detail of FIG. 3, an angle of typically 1-4 degrees, or preferably 2-3 degrees in most applications, is formed between the projection of respective front interior vertical folds 38, 40 (with substantially identical construction on the rear of semi-rigid container 12) and inwardly inclined fold portions 139, 141, so that the inwardly inclined fold portions 139, 141 incline or veer toward the center of the semi-rigid container 12 as the inwardly inclined fold portions 139, 141 approach the open bottom 16. This aids in the subsequent folding of the semi-rigid container 12 into the package 10.

As further shown in FIG. 3, corresponding first and second oval-shaped partially scored portions 47, 49 (typically cutting through a first layer of a multi-laminate or coated surface, however other similar methods, such as compressing, are considered to be within the definition of scoring) are formed with a vertical major axis on semi-rigid container 12 immediately below header 18, outwardly adjacent from first and second front interior vertical folds 38, 40 (thereby being located within the gusseted sides after the package 10 has been formed). During the formation of the package 10 from the semi-rigid container 12 and header 18, corresponding first and second oval-shaped dots of glue 51, 53 (with a horizontal major axis) are placed on one side of front of header 18, typically above reclosure or zipper 24 and inwardly adjacent from respective first and second cross-seals 21, 23. Additionally, a dot of glue 55 may be placed just below the mid-point of the top edge of header 18. Typically, hot melt glue is used, but other glues or adhesives may be applicable to various applications. During formation of the package 10 from the semi-rigid container 12 and header 18, the header 18 is folded down against the sides of the formed semi-rigid container 12 so that first and second oval-shaped dots of glue 51, 53 cover and are glued or otherwise secured to respective first and second oval-shaped partially scored portions 47, 49. Similarly, dot of glue 55 tacks the top edge of header 18 against the folded-down sidewall 20. Thereafter, when the user lifts the header 18 so as to break the connection formed by first and second oval-shaped dots of glue 51, 53, typically only the relatively well-defined first and second oval-shaped partially scored portions 47, 49 are torn from the semi-rigid container 12, with little or no unsightly fiber tears. First and second oval-shaped partially scored portion 47, 49 are typically provided only on the front of semi-rigid container 12. Otherwise, the front and rear views of semi-rigid container 12 are substantially identical. Alternately, releasable configurations may be used to attach the folded header to the sides of the formed semi-rigid container, such as, but not limited to, releasable adhesives, hook-and-eye (Velcro®), multiple strips, etc.

First diagonal fold 54 extends from the intersection of first interior vertical fold 38 and first horizontal fold 46 to the intersection of first folded edge 30 and second horizontal fold 48. Similarly, second diagonal fold 56 extends from the intersection of second interior vertical fold 40 and first horizontal fold 46 to the intersection of second folded edge 32 and second horizontal fold 48. Additionally, as shown in FIG. 3, the lower corners are removed by first and second lower cuts 57, 59 which extend diagonally from the respective ends of second horizontal fold 48 to opposite ends of the bottom 16 of the semi-rigid container 12. This results in diagonal ends on fin seal 52 as shown in FIG. 4.

While not shown in the drawings, the final product of package 10 typically folds and seals the header 18 against the semi-rigid container 12.

It is desired to provide a conveyor which will unfold the folded configuration (or "blank") of FIG. 3 to a rectangular configuration, so that the storage volume of resulting carton can be subsequently filled and the bottom sealed to achieve the package 10 of FIG. 4. The product of FIGS. 3 and 4 is intended to be illustrative of a typical product used in the current conveyor. Those skilled in the art, after review of the present disclosure, that the conveyor of the present disclosure could be adaptable to a broad range of blanks and containers.

Figure 1:
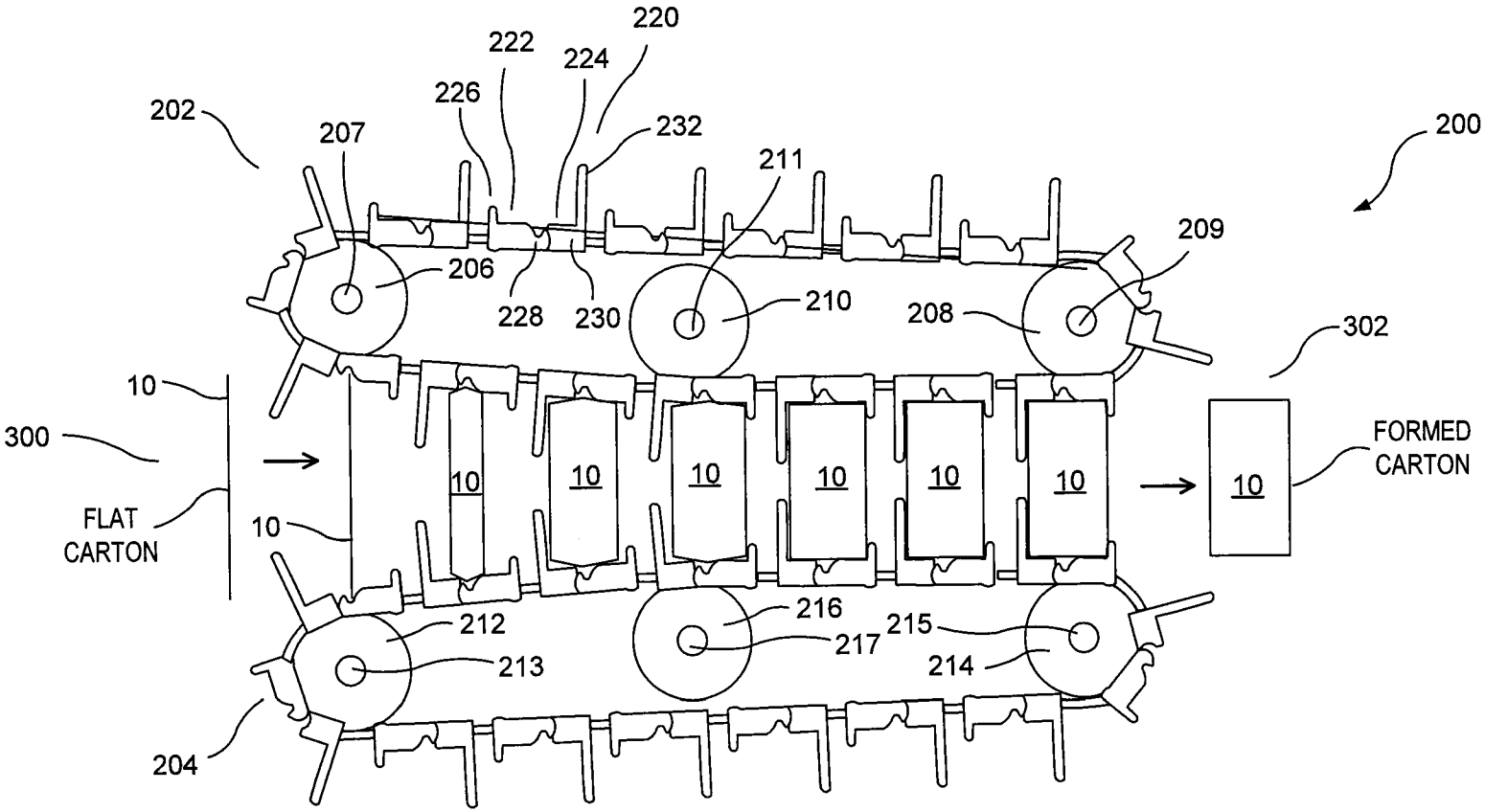
FIG. 1 is a top plan view of the apparatus of the present disclosure.
Figure 2:
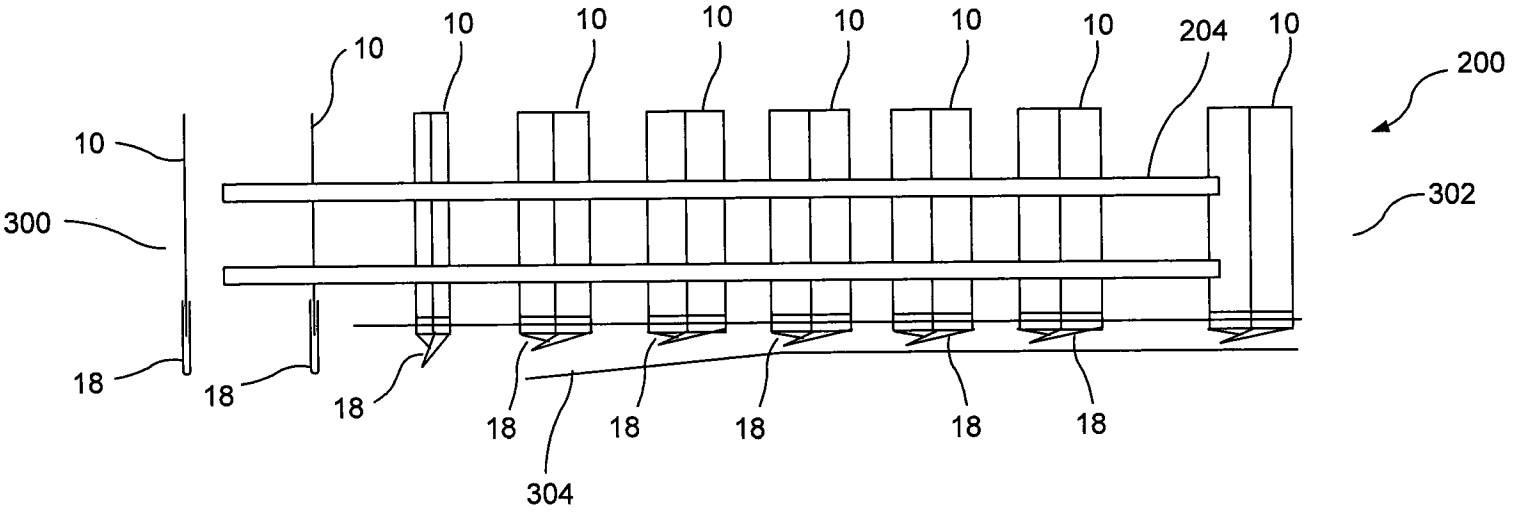
FIG. 2 is a side plan view of the apparatus of the present disclosure.

The conveyor 200 is disclosed in FIGS. 1 and 2. The conveyor 200 includes first and second lugged chain conveyor assemblies 202, 204, which are typically horizontally opposed (i.e., FIG. 1 is typically a top view) so as to finish with a carton 10 with an upwardly extending open bottom. First and second lugged chain conveyor assemblies 202, 204 are typically formed from metal. First lugged conveyor assembly 202 forms a loop around wheels 206, 208 which are journaled for rotation about respective axes 207, 209, typically with at least one of wheels 206, 208 being driven so as to operate the first lugged conveyor assembly 202 in the counterclockwise direction from the perspective of FIG. 1. Similarly, idler wheel 210, journaled for rotation about axis 211, is positioned in a central location within first lugged conveyor assembly 202 to maintain the proper positioning of the first lugged conveyor assembly 202. Similarly, second lugged conveyor assembly 204 forms a loop around wheels 212, 214 which are journaled for rotation about respective axes 213, 215, typically with at least one of wheels 212, 214 being driven so as to operate the second lugged conveyor assembly 204 in the clockwise direction from the perspective of FIG. 1, in concert or synchronized with the motion of first lugged conveyor assembly 202. Similarly, idler wheel 216, journaled for rotation about axis 217, is positioned in a central location within second lugged conveyor assembly 204 to maintain the proper positioning of the second lugged conveyor assembly 204. More specifically, idler wheels 210, 216 are positioned so that the first and second lugged chain conveyor assemblies 202, 204 are spaced at a relatively greater distance from each other between wheels 206, 212, with this distance decreasing as the first and second conveyor assemblies 202, 204 approach idler wheels 210, 216. The distance between the first and second lugged conveyor assemblies 202, 204, is thereafter relatively constant between the idler wheels 210, 216 and the wheels 208, 214. In other words, axes 211, 217 of idler wheels 210, 216 are spaced from each other at a distance substantial equal to the distance between axes 209, 215 of respective wheels 208, 214. However, the distance between axes 207, 213 of respective wheels 206, 212 is somewhat greater than these distances thereby providing for a decreasing distance between the first and second lugged conveyor assemblies 202, 204 in the machine direction.

Both first and second lugged conveyor assemblies 202, 204 comprise a series of articulated lug segments 220 forming a closed loop. Articulated lug segments 220 include first and second lug segment portions 222, 224 in articulated relationship with each other. First lug segment portion 222 includes with a protruding forward guide portion 226 and notch 228 for initially engaging the edge of the folded blank for carton 10 (see FIG. 3), typically with header 18 pointing downwardly. Second lug segment portion 224 has an L-shape formed from base 230 and protruding rear guide portion 232. As can be seen from FIG. 1, first and second lug second portions 222, 224 pivot or hinge with respect to each other as they pass around wheels 206, 208, 212, 214. When the lug segments 220 are traveling in a relatively straight line, with base 230 aligned with first lug segment portion 222, the protruding front and rear guide portions 226, 232 are parallel to each other and the distance separating the protruding forward guide portion 226 from the protruding rear guide portion 232 is equal to the depth of the carton 10 (see sides 34, 36 of FIG. 4). Likewise, the first and second lugged conveyor assemblies 202, 204 are oriented so that at the entry end 300, the opposed notches 228 of opposed lug segments 220 (one on first lugged chain conveyor assembly 202, another on second lugged chain conveyor assembly 204) are positioned so as to be separated by a distance of the width of the folded blank, which is typically equal to the sum of the width and depth of unfolded carton 10 (see FIG. 4), so that the series of folded cartons 10 (or "blanks") such as shown in FIG. 3 may be sequentially engaged between the opposed notches 228 of opposed lug segments 220. However, the first and second lugged chain conveyor assemblies 202, 204 progressively become closer to each other as they approach idler wheels 210, 216 whereby the carton 10 initially forms an irregular hexagon as it partially unfolds, and finally, after passing idler wheels 210, 216, where the bases 230 of opposing articulated lug segments 220 are separated by a distance equal to the width of the cartons 10, form the rectangular or orthogonal shape of carton 10 with a storage volume therewithin, with the width and depth of the open carton 10 at exit end 302 (see FIG. 4 for the carton 10 as produced at exit end 302, after subsequent filling of the carton 10 and sealing of the bottom of carton 10).

As shown in FIG. 2, the blanks for carton 10 are typically fed in an inverted configuration with the header 18 at a lower or bottom position. This allows film guide 304 to fold header 18 in a consistent direction, which is typically opposite to the machine direction of the blanks. This configuration further presents an upward extending open bottom in order to allow for the subsequent step of filling the cartons 10, prior to sealing the bottom of cartons 10.

Thus the several aforementioned objects and advantages are most effectively attained. Although preferred embodiments of the invention have been disclosed and described in detail herein, it should be understood that this invention is in no sense limited thereby and its scope is to be determined by that of the appended claims.

What is claimed is:

1. A conveyor assembly for unfolding a folded container blank, including:

a first conveyor lug assembly;

a second conveyor lug assembly opposing the first conveyor lug assembly, thereby forming an entry end at a first end of the first and second conveyor lug assemblies, and an exit end at a second end of the first and second conveyor lug assemblies, a portion of the second conveyor lug assembly proximate to the exit end being parallel to the first conveyor lug assembly;

the first and second conveyor lug assemblies being formed from a series of lug segments, the lug segments of the first and second conveyor lug assemblies including respective first and second opposed engagement elements for engaging edges of a folded blank at the entry end;

the lug segments of the first and second conveyor lug assemblies including first and second articulated portions directly connected to each other and pivoting with respect to each other, wherein the first articulated portion includes a first protruding guide portion and the second articulated portion includes a second protruding guide portion; and the opposed engagement element of the first conveyor lug assembly being closer to the opposed engagement element of the second conveyor assembly at the exit end than at the entry end, thereby pushing the edges of the folded blank toward each other and unfolding the folded container blank as the container blank travels from the entry end to the exit end.

2. The conveyor assembly of claim 1 wherein the opposed engagement elements of the first and second conveyor lug assemblies are respective first and second opposed notches.

3. The conveyor assembly of claim 2 wherein, at the entry end, the first and second opposed notches are spaced apart by a distance equal to the sum of the width and depth of a package to be unfolded from the folded container blank.

4. The conveyor assembly of claim 3 wherein, at the exit end, the first and second protruding guide portions are spaced apart by a distance equal to a depth of the package to be unfolded from the folded container blank.

5. The conveyor assembly of claim 4 wherein, at the exit end, the lug segments of the first and second conveyor lug assemblies are spaced apart by a distance equal to the width of the package to be unfolded from the folded container blank.

6. The conveyor assembly of claim 5 wherein the first and second conveyor lug assemblies are formed in a closed loop.

7. The conveyor assembly of claim 6 wherein the first conveyor lug assembly is looped around first and second wheels and the second conveyor lug assembly is looped around third and fourth wheels.

8. The conveyor lug assembly of claim 7 further including a fifth wheel between the first and second wheels, and a sixth wheel between the third and fourth wheels, wherein the fifth and sixth wheels are separated by a distance to bring the first and second conveyor lug assemblies to a closer distance from each other than that of the entry end.

9. A method of opening flat folded cartons to produce unfolded cartons with a storage volume therewithin, including the steps of:

providing a sequence of flat folded cartons;

providing a conveyor to open the flat folded cartons;

sequentially engaging the flat folded cartons;

operating the conveyor to open the cartons to produce unfolded cartons; and wherein the conveyor includes:

a first conveyor lug assembly;

a second conveyor lug assembly opposing the first conveyor lug assembly, thereby forming an entry end at a first end of the first and second conveyor lug assemblies, and an exit end at a second end of the first and second conveyor lug assemblies, a portion of the second conveyor lug assembly proximate to the exit end being parallel to the first conveyor lug assembly;

the first and second conveyor lug assemblies being formed from a series of lug segments, the lug segments of the first and second conveyor lug assemblies including respective first and second opposed engagement elements for engaging edges of a flat folded carton at the entry end;

the lug segments of the first and second conveyor lug assemblies including first and second articulated portions directly connected to each other and pivoting with respect to each other, wherein the first articulated portion includes a first protruding guide portion and the second articulated portion includes a second protruding guide portion; and the opposed engagement element of the first conveyor lug assembly being closer to the opposed engagement element of the second conveyor assembly at the exit end than at the entry end, thereby pushing the edges of the folded blank toward each other and unfolding the folded container blank as the container blank travels from the entry end to the exit end.

10. The method of claim 9 wherein the opposed engagement elements of the first and second conveyor lug assemblies are respective first and second opposed notches.

11. The method of claim 10 wherein, at the entry end, the first and second opposed notches are spaced apart by a distance equal to the sum of the width and depth of a package to he unfolded from the flat folded carton.

12. The method of claim 11 wherein, at the exit end, the first and second protruding guide portions are spaced apart by a distance equal to a depth of the package to be unfolded from the flat folded carton.

13. The method of claim 12 wherein, at the exit end, the lug segments of the first and second conveyor lug assemblies are spaced apart by a distance equal to the width of the package to be unfolded from the flat folded carton.

14. The method of claim 13 wherein the first and second conveyor lug assemblies are formed in a closed loop.

15. The method of claim 14 wherein the first conveyor lug assembly is looped around first and second wheels and the second conveyor lug assembly is looped around third and fourth wheels.

16. The method of claim 15 wherein the conveyor further includes a fifth wheel between the first and second wheels, and a sixth wheel between the third and fourth wheels, wherein the fifth and sixth wheels are separated by a distance to bring the first and second conveyor lug assemblies to a closer distance from each other than that of the entry end.

* * * * *